US010816310B2

(12) United States Patent
Tirmizi et al.

(10) Patent No.: US 10,816,310 B2
(45) Date of Patent: Oct. 27, 2020

(54) IGNITER WITH A LOCKED CONSOLIDATED POWDER CHARGE

(71) Applicant: SPECIAL DEVICES, INC., Simi Valley, CA (US)

(72) Inventors: Abrar A. Tirmizi, Simi Valley, CA (US); Vahan Avetisian, Newbury Park, CA (US); Gloria Vawter, Valencia, CA (US)

(73) Assignee: Special Devices, Inc., Moorpark, CA (US)

( * ) Notice: Subject to any disclaimer, the term of this patent is extended or adjusted under 35 U.S.C. 154(b) by 0 days.

(21) Appl. No.: 14/804,291

(22) Filed: Jul. 20, 2015

(65) Prior Publication Data

US 2015/0323295 A1 Nov. 12, 2015

Related U.S. Application Data

(63) Continuation of application No. 13/050,830, filed on Mar. 17, 2011, now abandoned.

(51) Int. Cl.
*F42B 3/12* (2006.01)
*F42B 3/195* (2006.01)

(52) U.S. Cl.
CPC ..... *F42B 3/124* (2013.01); *F42B 3/125* (2013.01); *F42B 3/195* (2013.01)

(58) Field of Classification Search
CPC ..... F42B 3/124; F42B 3/125; F42B 3/195
USPC ..... 102/202.5–202.14
See application file for complete search history.

(56) References Cited

U.S. PATENT DOCUMENTS 5,427,030 A 6/1995 Kidd et al.
5,431,101 A 6/1995 Arrell, Jr. et al.
5,454,320 A 10/1995 Hilden et al.
5,686,691 A * 11/1997 Hamilton ..... F42B 3/195 102/202.12
5,762,368 A 6/1998 Faigle et al.
5,772,243 A 6/1998 Green et al.
5,794,973 A 8/1998 O'Loughlin et al.
(Continued)

OTHER PUBLICATIONS

Restriction Requirement dated Jun. 12, 2013 issued in parent U.S. Appl. No. 13/050,830.
(Continued)

*Primary Examiner* — Bret Hayes
(74) *Attorney, Agent, or Firm* — Alexander R. Schlee; Schlee IP International, PC

(57) ABSTRACT

An igniter with a charge sleeve is provided with a through hole having a cylindrical wall, a bridge wire extending at least partially within the through hole, and a consolidated ignition powder charge retained within the through hole of the charge sleeve such that the bridge wire is at least partially embedded in the ignition powder charge. The cylindrical wall comprises at least one of i) a protrusion embedded into consolidated ignition powder charge, ii) a dimple filled with the consolidated ignition powder charge, and iii) at least 2 cylindrical wall sections that are eccentric to each other. The at least one of the protrusion, dimple and 2 cylindrical wall sections positively interlock with the consolidated ignition and output powder charge to prevent the charge both from moving in a radial direction in relation to the bridge wire and from rotating in relation to the bride wire.

2 Claims, 3 Drawing Sheets

(56) References Cited

U.S. PATENT DOCUMENTS

| | | | |
|---|---|---|---|
| 5,847,310 | A | 12/1998 | Nagahashi et al. |
| 5,893,583 | A | 4/1999 | Blumenthal et al. |
| 5,951,042 | A | 9/1999 | O'Loughlin et al. |
| 6,012,737 | A | 1/2000 | Van Wynsberghe et al. |
| 6,062,599 | A | 5/2000 | Forbes et al. |
| 6,106,009 | A | 8/2000 | Katsuda et al. |
| 6,145,877 | A | 11/2000 | Rink et al. |
| 6,295,935 | B1 | 10/2001 | Swann et al. |
| 6,357,792 | B1 | 3/2002 | Shirk et al. |
| 6,454,306 | B1 | 9/2002 | Cunningham et al. |
| 6,722,694 | B1 | 4/2004 | Nakashima et al. |
| 6,789,485 | B2 | 9/2004 | Moquin et al. |
| 6,979,024 | B2 | 12/2005 | Cunningham et al. |
| 7,004,071 | B2 | 2/2006 | Avetisian et al. |
| 7,082,999 | B2 | 8/2006 | Arnot |
| 7,083,193 | B2 | 8/2006 | Okamoto et al. |
| 7,210,703 | B2 | 5/2007 | Young et al. |
| 7,229,100 | B2 | 6/2007 | Cunningham et al. |
| 7,239,225 | B2 | 7/2007 | Tirmizi |
| 7,263,929 | B2 | 9/2007 | Takahara |
| 7,267,056 | B2 | 9/2007 | Takahara et al. |
| 7,316,187 | B2 | 1/2008 | Hansen |
| 7,343,859 | B2 | 3/2008 | Matsuda et al. |
| 7,357,083 | B2 | 4/2008 | Takahara et al. |
| 7,370,885 | B2 | 5/2008 | Stevens |
| 7,377,545 | B2 | 5/2008 | Kodama et al. |
| 7,404,573 | B2 | 7/2008 | Nishimura et al. |
| 7,407,184 | B2 | 8/2008 | Stevens et al. |
| 7,438,313 | B2 | 10/2008 | Bilbrey et al. |
| 7,448,649 | B2 | 11/2008 | Dunham et al. |
| 7,516,701 | B2 | 4/2009 | Kurita et al. |
| 7,516,983 | B2 | 4/2009 | Suehiro et al. |
| 7,530,310 | B2 | 5/2009 | Hironaka et al. |
| 7,574,960 | B1 | 8/2009 | Dockery et al. |
| 7,685,939 | B2 | 3/2010 | Narumi |
| 7,695,007 | B2 | 4/2010 | Cord |
| 7,721,652 | B2 | 5/2010 | Yoshida et al. |
| 7,758,709 | B2 | 7/2010 | Hussey et al. |
| 7,780,193 | B2 | 8/2010 | Hayakawa et al. |

OTHER PUBLICATIONS

Reply to Restriction Requirement dated Jun. 12, 2013 issued in parent U.S. Appl. No. 13/050,830.

Non-Final Office Action dated Oct. 11, 2013 issued in parent U.S. Appl. No. 13/050,830.

Reply to Non-Final Office Action dated Oct. 11, 2013 issued in parent U.S. Appl. No. 13/050,830.

Final Office Action dated Dec. 4, 2014 issued in parent application U.S. Appl. No. 13/050,830.

Reply to Final Office Action dated Dec. 4, 2014 issued in parent U.S. Appl. No. 13/050,830.

Non-Final Office Action dated Feb. 20, 2015 issued in parent U.S. Appl. No. 13/050,830.

* cited by examiner

IGNITER WITH A LOCKED CONSOLIDATED POWDER CHARGE

CROSS-REFERENCE TO RELATED APPLICATION

This application is a Continuation Application claiming the benefit of U.S. non-provisional patent application Ser. No. 13/050,830 filed on Mar. 17, 2011. The entire content of this parent U.S. patent application Ser. No. 13/050,830 is herewith incorporated by reference.

FIELD OF THE INVENTION

The present invention relates to initiators, primers and micro gas generators (MGG) used for automotive, military & industrial applications.

BACKGROUND OF THE INVENTION

In some initiators, primers and MGG designs—which should be understood as collectively covered by the more generic term "igniters" used in the following, the bridge wire is not protected by any ignition charge holder and the ignition charge and output charges are always in intimate contact with each other such that a good heat transfer from the bridge wire into the output charge is guaranteed. The output powder and ignition are consolidated together using a bridged header pressing into an output can. The output can, the consolidated powder charge, and the bridged header have typically been concentric to each other. During exposure to the environments such as thermal shock and cycling, the ignition plus output charge could become loose in the output can and stress the bridge wire during mechanical shock or vibration that could lead to bridge wire failure. Such failures are due to both loose powder slug rattling as well as the powder slug rotating inside the output can applying both tensile and torsional loads on the bridge wire under severe environments.

The inside of the output can is a smooth cylindrical surface and provides a poor surface for adhesion or anchoring of the output charge to the inside of the output can. What little adhesion of the output charge is attained during initial powder consolidation process could be eroded or de-laminated during thermal shock and cycling due to difference in thermal coefficients. Once these parts are exposed to mechanical shock and vibration the powder may become free to rotate inside the output can. An ignition charge holder also known as a charge sleeve can help mitigate this failure mode by using small amounts of ignition charge which is de-coupled from the output charge. However, in many instances the charge sleeve does not prevent the ignition charge from rotating due to environments which in turn could stress the bridge wire to a point of failure or degradation. The charge sleeve can be designed correctly to keep the ignition charge from rattling or rotating over the bridge wire due to environments described earlier. The disadvantage of using a charge sleeve is the cost of additional components, additional assembly steps and additional space required for this type of construction.

SUMMARY OF THE INVENTION

It is an object of the present invention to prevent movement of an ignition charge within an igniter, particularly movement of an ignition charge relative to a bridge wire in order to protect the bridge wire from failure such as detaching or breaking.

According to a first aspect of the invention, this is achieved by an igniter comprising: an output can comprising a bottom and a cylindrical wall; a header that is inserted at least partially into the output can and comprises a bridge wire; and a consolidated ignition and output powder charge retained within the output can between the bottom and the cylindrical wall and the inserted header such that the bridge wire is at least partially embedded into the ignition and output powder charge; wherein the bottom comprises at least one of a protrusion embedded into consolidated ignition and output powder charge and a dimple filled with the consolidated ignition and output powder charge.

According to a second aspect of the invention, this is achieved by an igniter comprising: an output can comprising a bottom and a cylindrical wall; a header that is inserted at least partially into the output can and comprises a bridge wire; and a consolidated ignition and output powder charge retained within the output can between the bottom and the cylindrical wall and the inserted header such that the bridge wire is at least partially embedded into the ignition and output powder charge; wherein the header comprises at least one of an eccentric retention sleeve and a flat on the header that is embedded in the consolidated ignition and output powder charge.

According to a third aspect of the invention, this is achieved by an igniter comprising: a charge sleeve comprising a through hole comprising a cylindrical wall; a bridge wire extending at least partially within the through hole; and a consolidated ignition powder charge retained within the through hole of the charge sleeve such that the bridge wire is at least partially embedded in the ignition powder charge; wherein the cylindrical wall comprises at least one of a protrusion embedded into consolidated ignition powder charge and a dimple filled with the consolidated ignition powder charge.

According to a fourth aspect of the invention, this is achieved by an igniter comprising: a defined space filled with at least an ignition charge; a bridge wire that is at least partially in heat transmitting contact with the ignition charge; and a means for locking the ignition charge into place with respect to the bridge wire such that any substantial relative motion between the ignition charge and the bridge wire is prevented.

DETAILED DESCRIPTION OF THE INVENTION

According to a preferred embodiment of the first aspect of the invention the output can is manufactured by deep-drawing and the at least one of a protrusion and a dimple in the bottom of the output can is formed by a die during the deep-drawing process. This is a cost efficient way of manufacturing a high quantity of such output cans. However, also other ways of manufacture like molding or machining are possible. Also, the corrugations can be formed in other ways, for instance by welding beads on the bottom of output can.

According to a preferred embodiment of the second aspect of the invention the eccentric retention sleeve is welded to the header. However, also other ways of attaching the retention sleeve are possible, for instance gluing or soldering. It is also possible to form the retention sleeve as an integral part of a header housing, either by machining or by coining the sleeve into the header.

According to a preferred embodiment of the second aspect of the invention the invention the header comprises a substantially cylindrical outer wall and the flats are coined into the cylindrical wall at an end of the cylindrical outer wall facing the consolidated ignition and output powder charge. The flats may only be on one side and basically carve off a segment of a circle from the cylindrical housing of the header. It is also possible to have more than one segment recessed, for instance 2 running in parallel, a triangular shape, a square shape, a hexagonal shape or any other shape. Also, the recessed part does not need to be a segment, it is for instance possible to have recesses intersect, preferable at a location close to the bridge wire. When the flats are coined, there is a lot of freedom in arranging and shaping the flats and as to the number of flats. When machining the flats instead of coining, it might be advisable to limit the number of flats for keeping the manufacturing process low. Preferably, the header comprises a substantially cylindrical outer wall and the flats are milled into the cylindrical wall at the end of the cylindrical outer wall facing the consolidated ignition and output powder charge. It is also possible to manufacture the header housing by molding, again offering a lot of flexibility in the shape of the powder charge locking mechanism which may also include other shapes than flats.

According to a preferred embodiment of the third aspect of the invention the through hole provided in the charge sleeve comprises in a longitudinal direction thereof at least a first cylindrical wall section of a first shape and a second cylindrical wall section of a second shape that differs from the first shape. While it is in the alternative possible to have only one shape, two different shapes offer the addition advantage of allowing to lock the consolidated powder charge also in an axial direction extending along the through hole into place.

According to a preferred embodiment of the third aspect of the invention the first cylindrical wall section has a smaller inner diameter than the second cylindrical wall section. This forms a step locking the consolidated powder charge also in axial direction into place within the charge sleeve. Preferably, the first cylindrical wall section is eccentric in relation to the second cylindrical wall section. In this case, the 2 cylindrical wall sections can even be of the same shape. The eccentricity prevents rotation of the powder charge, and at the same time creates kind of a half moon shaped step locking the powder charge in axial direction of the charge sleeve into place.

According to a preferred embodiment of the third aspect of the invention the second cylindrical wall section comprises indentations or teeth. These can either be formed into a step or annular shoulder between the first and the second cylindrical wall section if the diameter between both is different, or it can be formed in the cylindrical wall. When the charge sleeve is filled with consolidated powder charge, the powder charge fills or engages the indentation and acts like a powder tooth positively interlocking with the indentation. In case of teeth in the cylindrical wall, these engage the consolidated powder charge and therefore create the positive interlocking as well.

According to a preferred embodiment of the fourth aspect of the invention the defined space is an interior space defined by an output can comprising a bottom and a wall. The output can is preferably manufactured by deep-drawing and the means for locking the ignition charge into place are corrugations formed by a die during the deep-drawing process and the means for locking the ignition charge into place are deformations in the wall of the output can. This can be as simple as punching from the outside of the can a little hole into the can and further an indent into the cylindrical outer wall of the header housing such that some of the can material is pressed into the recess formed into the cylindrical wall of the header housing. In the alternative, many other ways of fixing the header to the can are possible, for instance gluing or welding. Also, an extra sealing can be provided at the rear end of the header housing. Any manufacturing needs to guarantee, of course, that the output can does not get too hot so that there is no risk of igniting the powder charge.

According to a preferred embodiment of the fourth aspect of the invention, the defined space is an interior space defined by a charge sleeve comprising a cylindrical wall, the cylindrical wall comprises in a longitudinal direction thereof at least a first cylindrical wall section and a second cylindrical wall section and a step extending between the first and second cylindrical wall sections, and the step between the first cylindrical wall section and the second cylindrical wall section is formed by at least one of the first and second cylindrical wall sections comprising different diameters and being eccentric with respect to each other. This design is advantageous in that only 2 cylindrical holes need to be provided in the charge sleeve. These cylindrical holes can be manufactured easily by machining, but even more easily by coining. As discussed above, this implements the double-function of both locking the consolidated powder charge into place axially as well as rotationally.

The invention achieves the aforementioned goals at a minimal impact on the overall cost or size of the device while preventing the powder slug from rattling or rotating inside the output can when exposed to severe environments. With the embodiment of the sculptured bottom of an output can, cruciform corrugations on the output can on the outside determines in addition the direction of the output can opening during functioning of the device. However, having this cruciform also the inside of the output can with minor modifications, it provides in addition the anti-rotating anchor to the output powder slug as well as stop the powder slug from rattling inside. Therefore, these corrugations formed by sculpturing the output can bottom can provide a double function of determining the output can opening direction in addition to locking the powder charge into place. At the same time this could be a transparent change for production requiring no changes to the assembly processes or tooling for existing products.

Another method of accomplishing the same results is to add a retention sleeve such as an eyelet or washer, smaller in diameter than the header and centered around the bridge wire to mimic a charge sleeve. Once the bridge wire is welded to the header assembly, a retention sleeve is welded/bonded to the header assembly on top of the bridge wire and eccentric to the diameter of the header. A circular retention sleeve is shown in the drawing but it could be elliptical, triangular or have more than 3 sides (triangular, square, rectangle, etc) or some irregular shape. It is not required to consolidate the ignition charge in the retention sleeve. The bridged header plus the retention sleeve are pressed into the output can holding the powder—as in the normal prior art manufacturing process. The retention sleeve will provide protection to the bridge wire during thermal and mechanical shock and vibration as well as provide an anchor and an anti rotational feature for the powder slug.

The low cost retention sleeve may be a standard metallic or non metallic eyelet or a washer produced by the fastener industry in large volumes at very affordable prices and would have a smaller diameter than the diameter of the header assembly. The ignition charge and output charges would be in intimate contact with each other and are consolidated in a single operation. There is minimal impact, if any, to the size of the device since there is no free volume with this concept. There is some cost impact with this option, however, the cost of retention sleeve and its assembly to the header is much smaller than the cost associated with welding a charge sleeve to the header and consolidating an ignition charge in it.

The third method achieving similar results is to coin retention features on the header body/face where the bridge wire gets welded. The header body is created using machining, stamping or fine blanking operations. After adding this feature the header face would like the existing AGH header with outline on the charge sleeve welded to it. The additional cost of adding this feature is going to be minimal, much less the cost of using a charge sleeve. There may be a small increase in the length of header body to accommodate the coined feature or the feature may be incorporated into the existing header body length. The bridge wire will be pushed higher up in the powder column while still laying flat on the glass that may also provide better ignition reliability.

On products where a charge sleeve must be used for ignition charge for some reason such as incompatibility between ignition and output charges or customer requirement, the anti rotation and retention features may be incorporated in the charge design to make it more robust. The current charge sleeve design has a concentric counter bore as the retention feature to hold the ignition charge in place. If the same counter bore is made "eccentric", the charge sleeve will not only hold the ignition charge in place but will also keep it from rotating due to environmental exposure. This feature will not add any additional cost to the charge sleeve or its installation process.

The current charge sleeve design has a concentric counter bore with a smooth line interface between the two diameters as the retention feature. In order to keep the ignition charge from rotating one or more indentations may be provided on the face of the counter bore. Once the ignition charge is pressed it will fill the indentation(s) that will keep it from rotating—which could otherwise happen due to use in rough environments. This feature would not add any additional cost to the charge sleeve or its installation process. Adding one or more grooves to the diameter of the bore will keep the ignition charge from rotating. Once the ignition charge is pressed into the bore, powder will fill the grooves and work as an anti rotation feature. The current charge sleeve design has a concentric counter bore with a smooth line interface between the two diameters as the retention feature. This feature may not add any additional cost to the charge sleeve or its installation process.

According to a first concept of the present invention the cruciform is located inside the output can and the bottom surface of the can is formed to have pronounced protrusions as retention features.

According to a second concept of the present invention a retention sleeve is attached around the bridge wire, the retention sleeve being positioned eccentrically in relation to the diameter of the header, thus providing an anchor for output charge from rotating as well as provides some protection against shock and vibrations for the bridge wire during use in environments.

A third concept is to coin one or more flats on the header surface. The flats will provide an anchor for the bridge wire after powder consolidation. Also, the bridge wire is pressed into the powder high in the column which may help increasing ignition reliability. Designs requiring a charge sleeve could use several different charge sleeve configurations. One is a round disk with an off-center counter bore and the other one is a round disk with a counter bore and one or more flats on the side. A rectangle, square, hexagon or other shapes may also be used for charge sleeve.

According to a first preferred embodiment a charge sleeve with eccentric counter bore as the anti-rotation feature is provided. According to a second preferred embodiment, indentations on the counter bore are provided as the anti-rotation feature. According to a third preferred embodiment grooves on the diameter of the counter bore are provided as the anti-rotation feature.

As materials, steel, brass, ferrous or non-ferrous alloy can be used. As a shape, an eyelet or washer, coined header face or coined cruciform can be used. Only minor adjustments to the powder loading process need to be made for implementing the present invention. For the second concept an SST washer or eyelet can be purchased and attached to the header after bridge wire welding using any number of different welding/bonding techniques, and the bridged header assembly with the retention sleeve is pressed into the output can like in AGI/FGI initiators and welded. For the third concept without the charge sleeve there would be an additional coining operation on the header body at the header manufacturer. However there would be no change in the remaining manufacturing and assembly process for implementing the present invention.

Although the ideas presented here are primarily targeted towards hermetically sealed automotive stainless and glass initiators, the same ideas are applicable to other types of initiators used by various industries such as plastic initiators where the retention features such as internal cruciform or its equivalent, retention sleeve or coined flats on the header will be molded into plastics and be even more cost effective than typical GTMS automotive construction.

These features are an improvement to existing automotive safety system application. However, the same concepts may be employed to improve the performance of initiators for commercial Mining & Blasting, Aerospace, Military, Construction, safety curtains and industrial applications.

Analyzing potential causes for bridge wire failures exposed to extreme temperature and mechanical shock and vibration environments revealed that the charge may rotate inside the output can and stress the bridge wire and that stopping the charge from rotating inside the can on AGI or FGI type construction would remove this problem.

In the following, the present invention and its advantages and equivalents is discussed in more detail by describing exemplary embodiments implementing the invention.

DETAILED DESCRIPTION OF THE DRAWINGS

Figure 1B:
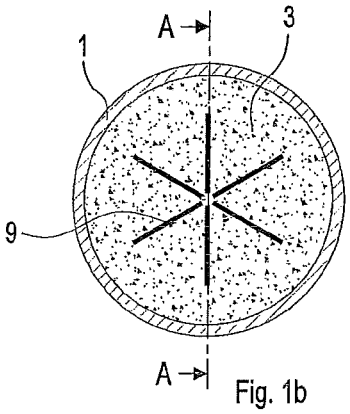
FIG. 1*b* shows a sectional view denoted B-B in FIG. 1*a* of the first embodiment shown in FIG. 1*a*.
Figure 1A:
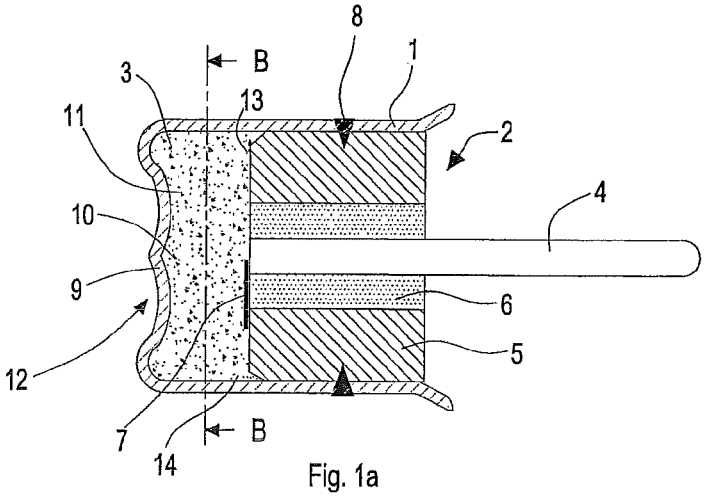
FIG. 1*a* shows a sectional view denoted A-A in FIG. 1*b* of a first embodiment comprising an output can having a consolidated ignition and output powder charge.

FIGS. 1*a* and 1*b* show a first preferred embodiment of the present invention. FIG. 1*a* is a sectional view along the line A-A as shown in FIG. 1*b*. FIG. 1*b* is a sectional view along the line B-B as shown in FIG. 1*a*. As shown in FIG. 1*a*, an output can 1 accommodates a header 2 and a consolidated ignition and output powder charge 3. The header 2 comprises an electrode 4, a housing 5, an insulator 6 and a bridge wire 7 that connects and the housing 5 with the electrode 4. The output can 1, the electrode 4, the housing 5 and the bridge wire 7 are made from electrically conductive material. The bridge wire 7 is typically in direct contact with or embedded into the consolidated powder charge 3 or at least in such close proximity that heat generated by the bridge wire 7 can easily be transferred from the bridge wire into the consolidated powder charge 3 for igniting the same.

The bridge wire 7 is heated by running electrical current through the electrode 4 via the bridge wire 7 into the housing 5 and finally the output can which might be grounded or contacted by a negative electrode. The consolidated powder charge 3 is typically inserted into the output can 1 in form of slurry that is allowed to consolidate. While it is also possible to fill in the powder charge as a dry powder and if need be compact this charge, in the manufacturing process, handling slurry during manufacturing rather than a dry powder charge is preferred for several reasons, most importantly for safety reasons since slurry is safer against inadvertent self-igniting during the manufacturing process and prevents hazardous and dangerous explosive dusts from escaping into the environment. The expression "consolidated" is to be understood for the purpose of the present patent application as any form of making the powder charge stick to some extent together and form a powder body, either by drying a slurry or by compacting a dry powder or by any other means like a chemical reaction like curing or any physical processing.

After the output powder charge 3 in the form of a slurry has been filled into the output can 1, the header 7 is then inserted into the output can 1 and fixed thereto by beads 8, for instance an adhesive or cured resin or simply by deforming the output can 1 from the outside such that a protrusion extends into respective recesses in the housing 5 of the header 2. The protrusions and recesses can be coined into the output can 1 and housing 5 from the outside.

The output can 1 is easy to manufacture by conventional punching and forming, for instance by a deep drawing process. According to this embodiment, the bottom of the output can 1 comprises several corrugations 9 which are arranged in a star-shaped form and create a number of dimples 10 and protrusions 11. These corrugations can be formed by pressing a male die part also used for the deep drawing action into a female die part forming the bottom 12 of the output can 1.

When filled into the output can 1, the powder charge 3 in form of slurry also fills the corrugations 9 which form the set of dimples 10 and protrusions 11. After the header 2 has been inserted into the output can locking the powder charge 3 in a longitudinal direction into place, the slurry can consolidate so that the then consolidated powder charge locks itself in place as to lateral movement and rotational movement with respect to the output can 1 since the then consolidated powder charge 3 fills the dimples 10 created by the corrugations 9. The consolidated power charge 3 is sandwiched between a front face 13 of the header 2 and the bottom 12 of the output can 1 locking it into place in an axial or longitudinal direction of the igniter, while holding it in radial direction in place by the cylindrical inner wall 14 of the output can 1. In a rotational direction, the corrugations 9 forming the protrusions 11 and the dimples 10 hold the output charge in place, i.e. prevent rotating. However, if under the severe conditions the output charge gets compacted in a radial direction so that an annular gap can form between the output charge 3 and in the cylindrical wall 14 of the output can 1, the dimples 10 and protrusions 11 still hold the output charge in place in a radial direction.

As a result, the output charge 3 is prevented from moving in a radial direction in relation to the bridge wire 7, and also is prevented from rotating in relation to the bridge wire 7 so that any shear forces acting from the output powder charge 3 onto the bridge wire 7 are prevented. This protects the bridge wire against a number of potential reasons for failure like detaching from the electrode 4 or housing 5 of the header, breaking due to excessive shear forces, and most importantly against any fatigue fracture, cracks or detaching due to vibrations.

Figure 2B:
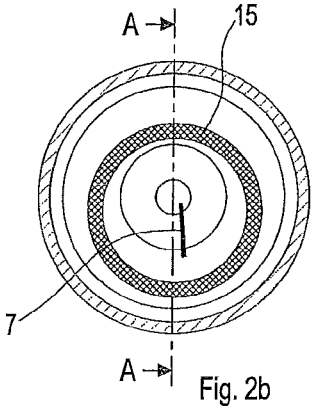
FIG. 2*b* shows a sectional view denoted B-B in FIG. 2*a* of the second embodiment shown in FIG. 2*a*.
Figure 2A:
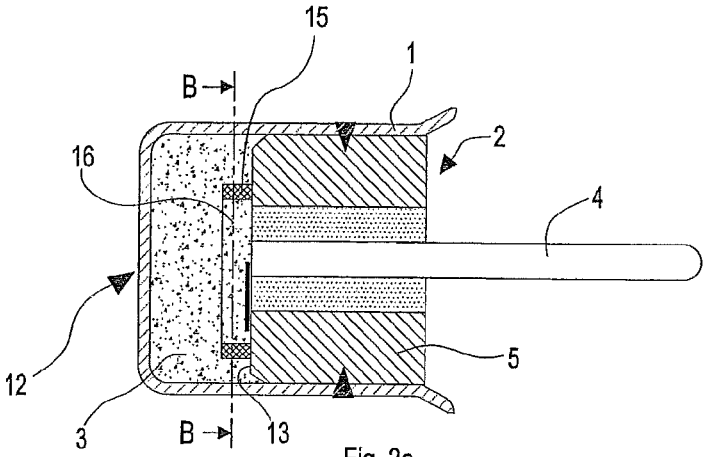
FIG. 2*a* shows a sectional view denoted A-A in FIG. 2*b* of a second embodiment comprising an output can having a consolidated ignition and output powder charge.

FIGS. 2*a* and 2*b* show a second preferred embodiment of the present invention. FIG. 2*a* is a sectional view along the line A-A as shown in FIG. 2*b*. FIG. 2*b* is a sectional view along the line B-B as shown in FIG. 2*a*. For the purpose of providing a clearer picture, the consolidated powder charge 3 is only shown by a number of dots in the FIG. 2*a* but omitted in the FIG. 2*b*. The same reference numerals as in FIG. 1 are used while not all of the reference numerals as described in connection with FIG. 1 are shown, only those that are specifically discussed in connection with this embodiment are shown in FIG. 2.

A retention sleeve 15 is welded to the front face 13 of the header 2 such that it is eccentric in relation to the electrode 4 and the output can 1. The bottom of the output can 1 can be flat according to this embodiment since the lateral and rotational movement of the consolidated output charge 3 is according to this embodiment prevented by the eccentricity of the retention sleeve 15. In the alternative, the bottom 12 of the output can also be provided with the corrugations 9 as shown in FIG. 1. The retention sleeve 15 can be attached to the front face 13 also by ways other than by welding, for instance by soldering, or gluing or it can be formed integrally with the housing 5 of the header 2. One additional advantage this design has is that it allows filling the retention sleeve 15 with an ignition charge 18 that may differ from the output charge 3. Also, this ignition charge 16 is much smaller and therefore lighter and less vulnerable to be compacted within the retention sleeve by inertial forces and vibrations that may occur in using the igniter in extreme environments.

Figure 3B:
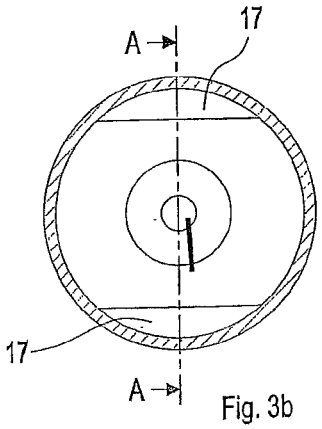
FIG. 3*b* shows a sectional view denoted B-B in FIG. 3*a* of the third embodiment shown in FIG. 3*a*.
Figure 3A:
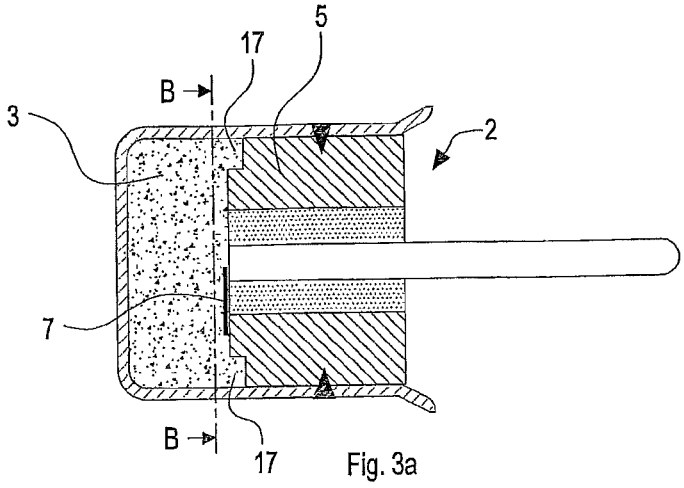
FIG. 3*a* shows a sectional view denoted A-A in FIG. 3*b* of a third embodiment comprising an output can having a consolidated ignition and output powder charge.

FIGS. 3*a* and 3*b* show a third preferred embodiment of the present invention. FIG. 3*a* is a sectional view along the line A-A as shown in FIG. 3*b*. FIG. 3*b* is a sectional view along the line B-B as shown in FIG. 3*a*. For the purpose of providing a clearer picture, the consolidated powder charge 3 is only shown by a number of dots in the FIG. 3*a* but omitted in the FIG. 3*b*. The same reference numerals as in FIGS. 1 and 2 are used while not all of the reference numerals as described in connection with FIGS. 1 and 2 are shown, only those that are specifically discussed in connection with this embodiment are shown in FIG. 3.

As a mechanism for preventing rotation of the consolidated powder charge 3, flats 17 are coined to the housing 5 of the header 2. The advantage of this embodiment is the very low manufacturing costs, since coining of these flats can be done in mass production at relatively low costs. In the alternative, these flats can be machined into the housing 5, for instance by milling. Since these flats are in a longitudinal or axial direction of the igniter very close to the bridge wire 7, this mechanism is in the form of the flats 17 preventing rotation and lateral movement of the output charge 3 and is located very close in space to this bridge wire 7 and therefore very effective. Also this embodiment in FIG. 3 allows the variation that the bottom 12 can be structured like in the embodiment shown in FIG. 1, i.e. comprise corrugations forming dimples and protrusions and therefore provide additional safety against any movement of the consolidated powder charge 3.

Figure 4A:
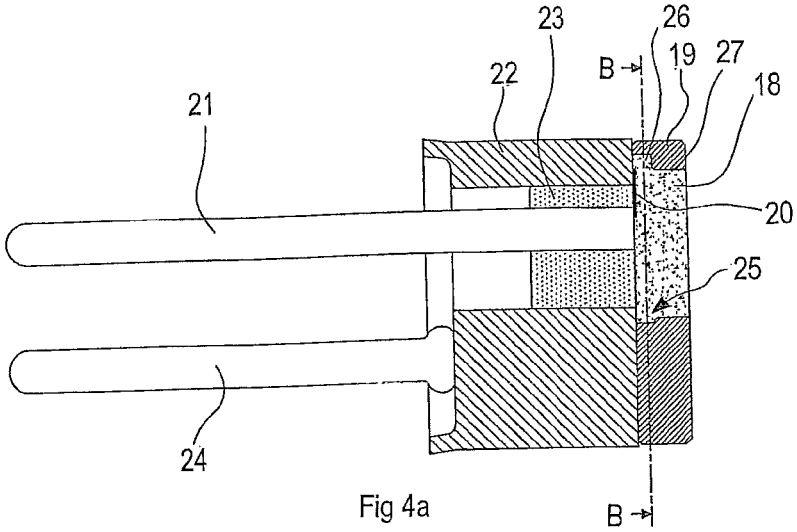
FIG. 4*a* shows a sectional view denoted A-A in FIG. 4*b* of a first embodiment comprising a charge sleeve having a consolidated ignition powder charge.
Figure 4B:
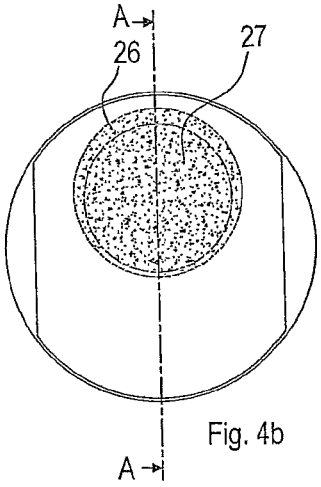
FIG. 4*b* shows a sectional view denoted B-B in FIG. 4*a* of the first embodiment shown in FIG. 4*a*.
Figure 5A:
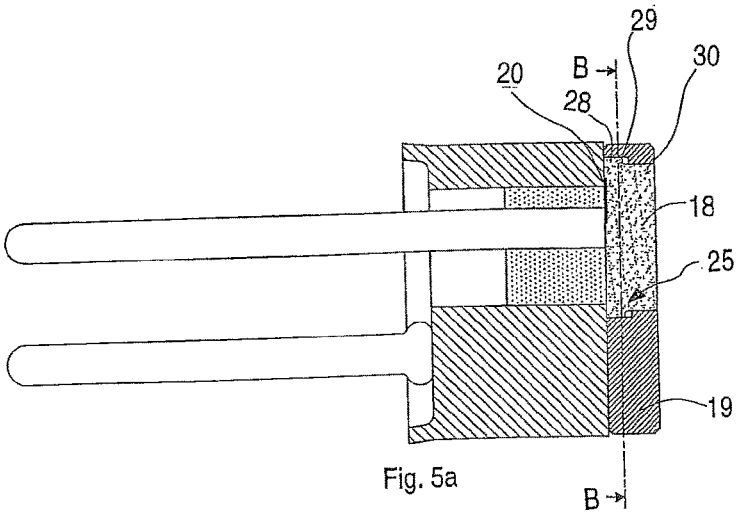
FIG. 5*a* shows a sectional view denoted A-A in FIG. 5*b* of a second embodiment comprising a charge sleeve having a consolidated ignition powder charge.
Figure 5B:
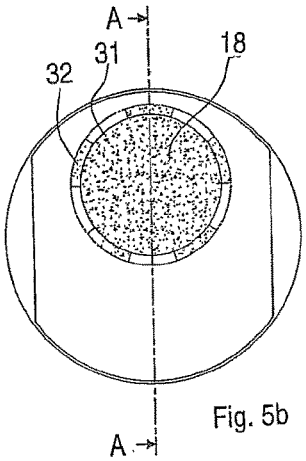
FIG. 5*b* shows a sectional view denoted B-B in FIG. 5*a* of the second embodiment shown in FIG. 5*a*.
Figure 6A:
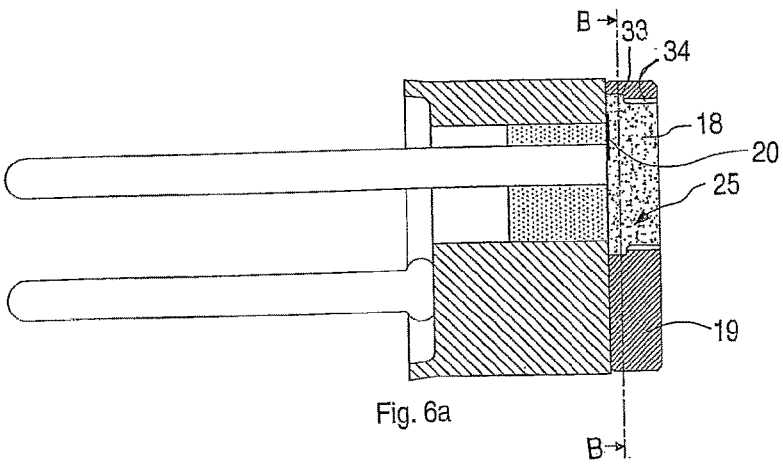
FIG. 6*a* shows a sectional view denoted A-A in FIG. 6*b* of a third embodiment comprising a charge sleeve having a consolidated ignition powder charge.
Figure 6B:
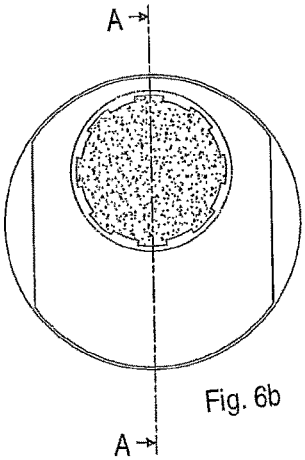
FIG. 6*b* shows a sectional view denoted B-B in FIG. 6*a* of the third embodiment shown in FIG. 6*a*.

FIGS. 4-6 show additional applications and implementations of the same inventive idea as described in connection with FIGS. 1-3 above, namely—turning first to FIGS. 4*a* and 4*b*-applying a similar mechanism for preventing rotation and lateral movement of a consolidated powder charge 18, here used as an ignition charge 18 contained in a charge sleeve 19. A bridge wire 20 extends from an electrode 21 to a housing 22. The electrode 21 is held in place within the housing 22 by an insulator 23, for instance glass or any other type of appropriate material like ceramics or cured resin. The housing 22 is made from electrically conductive material, preferably metal, and can either be grounded, or connected to a negative electrode 24. The charge sleeve 19 comprises a cylindrical wall 25 that comprises a first cylindrical wall section 26 and a second cylindrical wall section 27. The first cylindrical wall section 26 is slightly larger in diameter than the second cylindrical wall section 27 and is eccentric in relation to the second cylindrical wall section 27. This eccentricity forms effectively a protrusion preventing rotation of the ignition charge 18 within the charge sleeve 19 and therefore protects the bridge wire 20 from damage, as already discussed in detail in relation to FIGS. 1-3.

According to the embodiment shown in FIG. 5, the cylindrical wall 25 comprises three different sections, namely a first section 28 of the largest diameter, a second section 29 comprising in a circumferential direction protrusions 31 and indents 32 which are formed in a step that forms a transition between the first section 28 and a third section 30 having a smaller diameter than the first section 28. As shown in FIG. 5*b*, the indents 32 are filled with the consolidated ignition charge 18 and therefore form sort of teeth in the ignition charge 18 that interlock with the protrusions 31 of the charge sleeve 19. This interlocking mechanism prevents the consolidated powder charge 18 from rotating in relation to the charge sleeve 19, and therefore prevents a movement of the consolidated powder charge 18 in relation to the bridge wire 20.

In a similar fashion as in the embodiment shown in FIG. 5, also in the embodiments shown in FIG. 6, such interlocking teeth between the consolidated ignition power charge in a second section 34 of the cylindrical wall 25 that has a smaller diameter than a first section 33 of the cylindrical wall 25 are formed. The difference between the embodiments shown in FIGS. 6 and 5 is that the embodiment shown in FIG. 6 comprises only two cylindrical wall sections 33 and 34 and the teeth in the second cylindrical wall section 34 are extending over the entire remaining length of the cylindrical wall 25 which is not occupied by the first cylindrical wall section 33. Also here a step is formed between the first cylindrical wall section 33 and the second cylindrical wall section 34 due to a difference in the internal diameter, but this step is not a continuous annular shoulder in a circumferential direction as the gaps between the teeth extend over the entire length of the second cylindrical wall section 34, thus the annular shoulder is interrupted by the gaps formed between the teeth.

In all three embodiments shown in FIGS. 4-6, a step is provided, preventing an axial or longitudinal motion of the consolidated ignition powder charge, and some kind of protrusion, indent or teeth interlocking with the powder charge for preventing any rotation movement. This holds the consolidated power charge in place in longitudinal direction, but at the same time protects the bridge wire 20 from damage by preventing rotation of the powder charge.

The aforementioned embodiments are only shown and explained for the purpose of illustration. The present invention is not limited to these exemplary embodiments.

What is claimed is:

1. An igniter comprising:

a charge sleeve comprising a through hole comprising a cylindrical wall;

a bridge wire extending at least partially within the through hole; and a consolidated ignition and output powder charge retained within the through hole of the charge sleeve such that the bridge wire is at least partially embedded in the consolidated ignition and output powder charge; wherein the cylindrical wall comprises at least 2 cylindrical wall sections that are eccentric to each other, wherein each of the at least 2 cylindrical wall sections that are eccentric with respect to each other positively interlock with the consolidated ignition and output powder charge to prevent the charge both from moving in a radial direction in relation to the bridge wire and from rotating in relation to the bridge wire.

2. The igniter of claim 1, wherein a step extends between a first cylindrical wall section and a second cylindrical wall section of the at least two cylindrical wall sections.

* * * * *